US007395678B2

(12) United States Patent
Arno et al.

(10) Patent No.: US 7,395,678 B2
(45) Date of Patent: Jul. 8, 2008

(54) REFRIGERANT RECEIVING APPARATUS

(75) Inventors: Raymond P. Arno, East Amherst, NY (US); David R. Arno, East Amherst, NY (US); John A. Carlin, Buffalo, NY (US)

(73) Assignee: Parker-Hannifin Corp., Cleveland, OH (US)

( * ) Notice: Subject to any disclaimer, the term of this patent is extended or adjusted under 35 U.S.C. 154(b) by 407 days.

(21) Appl. No.: 11/070,345

(22) Filed: Mar. 2, 2005

(65) Prior Publication Data

US 2005/0217312 A1 Oct. 6, 2005

Related U.S. Application Data

(60) Provisional application No. 60/559,082, filed on Apr. 2, 2004.

(51) Int. Cl.
*F25B 41/00* (2006.01)

(52) U.S. Cl. ..... 62/511; 62/513

(58) Field of Classification Search ..... 62/503, 62/511–512, 513
See application file for complete search history.

(56) References Cited

U.S. PATENT DOCUMENTS 3,938,349 A * 2/1976 Ueno ..... 62/192
4,757,696 A * 7/1988 Gannaway ..... 62/503
RE33,775 E 12/1991 Behr
5,099,655 A 3/1992 Arno
5,207,072 A 5/1993 Arno
5,561,987 A * 10/1996 Hartfield et al. ..... 62/471
5,829,265 A * 11/1998 Lord et al. ..... 62/298
5,996,372 A * 12/1999 Koda et al. ..... 62/503
6,490,877 B2 12/2002 Bash
6,516,626 B2 2/2003 Escobar
6,516,627 B2 * 2/2003 Ring et al. ..... 62/471
6,935,123 B2 * 8/2005 Ross ..... 62/66
7,073,572 B2 * 7/2006 Ayub ..... 165/146

* cited by examiner

*Primary Examiner*—William E Tapolcai
(74) *Attorney, Agent, or Firm*—Kloss, Stenger & Lotempio; Vincent G. Lotempio

(57) ABSTRACT

A system for modulating refrigerant flow from an evaporator of an air or gas drying apparatus wherein the air or gas drying apparatus has an evaporator shell with at least one exit orifice for return of refrigerant to an accumulator or compressor. The system comprising a flow metering structure connected to the at least one exit orifice, the structure having an internal tube with a vertical rise from an evaporator shell end to an accumulator or compressor end, the internal tube having at least one return orifice (a) which allows passage of liquid refrigerant outside the internal tube into the internal tube, and at least one return orifice (b) which allows passage of gas outside the internal tube into the internal tube.

17 Claims, 9 Drawing Sheets

REFRIGERANT RECEIVING APPARATUS

This application claims priority of U.S. Provisional Patent Application 60/559,082, filed on Apr. 2, 2004, titled: METERED REFRIGERANT RETURN PROCESS FOR COMPRESSED GAS/AIR DRYERS AND METHOD THEREFORE.

BACKGROUND OF THE INVENTION

1. Field of the Invention

The present invention relates to the field of refrigerant, compressed gas/air dryer systems, and more particularly to a refrigerant receiving apparatus which meters and stabilizes the return of refrigerant in compressed gas/air refrigerant dryer systems.

2. Background and Prior Art

Presently, many industrial applications using air or gas driven machinery have a need for dry air or gas in the process of operating, product process, product fabrication, as well as many other applications. Air or gas driven machinery is most commonly operated using pressurized, i.e., compressed air or gas that contains water that can react on or condense within product or apparatus and negatively impact the air or gas usefulness. Moisture negatively impacts the product process systems by causing costly equipment maintenance or equipment failure and befouled product.

Typically, because of the compression process, compressed air or gas is saturated with 100% relative humidity; water in excess of the humidity capacity condenses as moisture on machine or product surfaces. When the volume is reduced, i.e., the air is pressurized or compressed, the dew point for water is approached or exceeded thereby causing condensation. Filters and traps only take out water (if any) already condensed out of the compressed air or gas as it has cooled. These filter/trap systems do nothing to remove the 100% relative humidity representing water in vapor phase still remaining in the compressed air/gas. As the air or gas cools condensation is exacerbated.

Refrigerant dryers are the most common means for acceptably removing moisture from compressed air or gas for industrial uses. The quality of the gas/air being dried at the dryers output is measured in terms of dew point; the lower the dew point temperature, the greater the dryness of the gas/air and thus the higher the quality of the process. Generally the acceptable dew point ranges is between 33° F. and 50° F. depending on the application. More water vapor in the feed air or gas and higher pressures from compression each make achieving acceptable dew point more difficult. There are several methods of refrigerant dryer operations; the following are some of the more conventional systems: Cycling Dryers, Non-Cycling Dryers, Mass Storage and Variable Speed Drive Dryers.

Simply described, refrigerant air or gas dryers use: i) a refrigerant compressor (with appropriate accumulator and receiver apparatus), ii) a series of heat exchanger vessels and/or other heat transfer apparatus, a condensing apparatus, and, iii) refrigerant process control apparatus (expansion, pressure regulating, hot gas valves, bypass valves; solenoids and electronic sensors/controls with or without variable speed drive (VSD) devices for the compressor motor; etc.). These systems each operate at various levels of efficiency, both with respect to cost and dew point performance.

Various refrigerant dryer devices have been designed to take the water vapor from the air, for example, the system of U.S. Pat. No. 5,207,072 to Arno features a cycling configured refrigerant air or gas dryer with an unloading means that allows a compressor motor to coast or free wheel during periods of low demand for refrigerant cooling. Thus, this advanced cycling dryer is said to be an energy savings dryer as compared to conventional non-cycling systems. Another example is a system configured with a VSD device to modulate the compressor during the period of lower demand for refrigerant cooling. A system so configured would be considered an energy saving dryer because the compressor is consuming less energy during the lull intervals.

However, each of these above listed devices use an expansion valve to feed or deliver compressed refrigerant into a heat exchange type vessel, where the expansion of refrigerant produces a coldest point for heat exchange purposes. Expansion valves rely on a temperature and pressure feedback which causes the valve opening to either increase in size for greater refrigerant feed, or, decrease in size for less refrigerant feed. These valves are conventionally available as strictly mechanical valves or in combinations of mechanical and electrical and/or electronic (solenoid, proportional, step motor drive, etc. with or without microprocessor control) valves; all having the desired goal to feed expanded refrigerant as required by the recycling means back to the refrigerant side of a heat exchanger providing a coldest point for thermal exchange.

One of the problems in this type of device is that the expansion valves are called-out in terms of tonnage (the capacity with which the device can deliver expanded refrigerant and feed the system). The tonnage is expressed as a range based on differential pressure; for example, 10 tons (generally for operating in systems from about 80,000 btus to about 120,000 btus capacity requirements). When these devices are specified in the design of a system, the tonnage expressed could actually be implemented as on the low side, in the mid range, or, on the high side of the valve capability to deliver refrigerant feed. This means, in simple terms, that the valve in any particular system may be required to work near maximum capacity, in a mid range, or barely working efficiently at low capacity, each, respectively in each design. That equates, in each of the scenarios, to the valve working less than ideal for most of the range of the system designs capacities.

Another problem that exists in conventional systems is flooding. Flooding refers to the ability to keep the evaporator refrigerant side full with liquid. As load on the system operates, the refrigerant boils off and returns; leaving the evaporator only partially flooded. In such a scenario, an evaporator could be partially filled with liquid and the remaining space filled with vapor or foam from the boiling instigated by the evaporator valve. Vapor or foam within the evaporator does not transfer heat as efficiently as the liquid does, thus the efficiency of the evaporator suffers because the contact surface area with liquid for heat exchange is less than ideal.

To broaden the range of efficient operation of the valves use in varied systems, the expansion valve is conventionally adjusted. The adjustment is expressed in terms of superheat; a value derivative equivalent to the refrigerant systems compressor suction pressure converted to degrees in temperature (as related to a specific refrigerant type) and subtracted from the refrigerant systems suction temperature.

An expansion valve may generally be used over a wide tonnage range. Thus factory adjustment for superheat is undesired. Each valve must be set for superheat to reflect 10-15° F. over room temperature. To set the superheat, one must use a thermocouple or thermometer to measure the temperature of the suction line, for example, at a thermal bulb. Then one measures the pressure in the suction line at the thermal bulb well or external equalizer. The measured suction is then converted to a pressure equivalent saturated temperature using a pressure temperature chart. The difference between this value and the temperature measured at the thermal bulb well is expressed as the superheat. Superheat is often in the approximate range of five to ten degrees F.

Ideally, the superheat (a value derived from suction temperature and suction pressure), would give feedback to the expansion valve to close-down (a call for less refrigerant) to maintain a predetermined level of performance. Conversely, when the call is to increase refrigeration, the change in superheat would cause the expansion valve to open-up and feed more expanded refrigerant.

Unfortunately, no valve devices work at an optimum under most or all conditions in any given system or design. In practice the parameters routinely overshoot. The result is an expansion valve hunting endlessly. That is the valve will open-up for more feed which will be followed by a close-down because of too much feed, and again, an open-up because of too little feed resulting in a drop of the flooding level; resulting in a never ending cycle. This phenomenon occurs in every system at some point even in carefully designed systems using the mid range as ideal or with sophisticated electronically assisted expansion valve devices. This hunting, over/under, constant pursuit to satisfy the endless loop of superheat feedback results in less than ideal performance of the gas/air dryer system desired to produce a low, constant dew point temperature gas or air. The hunting results from the refrigerant being returned in an erratic manner.

In U.S. Pat. No. 5,099,655 to Arno, the inventor directly addressed the negative result of having only a partially flooded evaporator. U.S. Pat. No. 5,099,655 teaches that having a suction line heat exchanger, as a flooding level control, effectively breaks-up liquid slugs of refrigerant return. This was accomplished by using the discharged refrigerant out of the compressor on one side of the flooding level control suction line heat exchanger, while the return flow is through the other side. The hot discharge tends to flash the liquid slug to its vapor state and thusly, reduces its effect on the expansion valve regulating bulb. The result is a higher level of liquid refrigerant in the evaporator. However, even this improved apparatus can still suffer from the overfeed/underfeed problem scenario.

U.S. Pat. No. 5,207,072 to Arno discloses an unloading structure for compressors of refrigerant systems, and, U.S. Pat. No. 5,099,655 teaches level control for refrigerant systems that use flooded shell evaporators.

U.S. Pat. No. 6,516,626 to Escobar, discloses a two stage refrigeration system incorporating a means for storing refrigerant vapor and slurry having a receiving tank or tanks. U.S. Pat. No. 6,490,877 to Bash, teaches parallel evaporators and a means to control the mass flow rate of the refrigerant to each evaporator. Reissue patent RE 33,775 to Behr, shows multiple evaporators and method of controlling the valve in a refrigeration system. However, the various prior systems are undesirable in that they do not provide precise control.

Thus the state of the art is clearly not ideal. Normal load changes during industrial cycles can adversely affect dryer operations, resulting in poor dew point performance, waste of energy and wear-and-tear of equipment. The industry has accepted that it is the nature of refrigerated gas/air dryer systems even those having sophisticated electronically assisted expansion valves to function with cyclical operation expansion and thus routinely experience the same over/under performance.

Thus it is readily apparent that there is a longfelt need for a means for metered or controlled refrigerant return from an evaporator system and for a process to maintain stable, balanced parameters affording a very high performance true flat-line in dew point of a gas/air dryer system, that is a means and process that sets forth a method for controlling the rate at which the metered return occurs and a system that will modestly modulate return (always track the demand and will output perfect dew point temperature according to the gas/air dryers load).

SUMMARY OF THE INVENTION

It is a general object of the present invention to provide an improved process to return refrigerant from an evaporator of any refrigerant gas or air dryer, either employing unloading, cycling or non cycling, or even in combination with a variable speed driven refrigerant compressor;

Another object of the present invention is to provide an apparatus and system for modulating refrigerant flow from an evaporator of an air or gas drying apparatus wherein the process maintains stable, balanced parameters affording a very high performance in dew point of a gas/air dryer system;

Still, another object of the present invention is to modulate operation upon the introduction of brief gulps/overfeed situations and deliver metered return by the refrigerant flashing at a rate relative to the suction under any given demand;

Still, another object of the present invention is to provide metered return that allows full capacity when needed (when demand is great), moderate return as requirements call for less, and uniquely, a vernier to trim the need for any demand to an exact return;

Yet another object of the present invention is to provide a system that has the capability to respond to varying demands quickly as levels inside and outside the internal flow metering structure, causing the levels to rise or fall, and, engaging one or more metering holes or a larger area of metering hole as the case may be;

An additional object of the present invention is to provide a system that has the capability to respond to extraordinary or large load changes by appropriate rapid shutdown of the expansion feed and rapid delivery of a slug of refrigerant in such cases where demand is sudden;

A further object of the present invention is to provide a system that features a completely self-contained cup or cylinder that can be retrofitted and inserted in the path of return line;

A still further object of the present invention is to provide a system that features a surge vessel in large capacity systems where great amounts of refrigerant can be accommodated and a large overflow volume may extend up into the surge vessel where the metered return can take place;

Still another object of the present invention is to flatten the operating parameters to stable and desired measurement values and achieve balance by reducing the peaks and valleys of oscillations causes in the conventional expansion process;

Yet another object of the present invention is to modestly modulate and achieve near perfect dew point temperature according to the air or gas dryers load capacity by always tracking the demand; and A further object of the present invention is to provide a method for controlling the rate at which the metered refrigerant return occurs.

These and other objects are achieved in accordance with the present invention which provides a system for modulating refrigerant flow from an evaporator of an air or gas drying apparatus wherein the air or gas drying apparatus has an evaporator shell with at least one exit orifice for return of refrigerant to an accumulator or compressor. The system comprising a flow metering structure connected to the at least one exit orifice, the structure having an internal tube with a vertical rise from an evaporator shell end to an accumulator or compressor end, the internal tube having at least one return orifice (a) which allows passage of liquid refrigerant outside the internal tube into the internal tube, and at least one return orifice (b) which allows passage of gas outside the internal tube into the internal tube.

In a preferred embodiment, the present invention is used with any type of refrigerant expansion valve (mechanical or in combination of electromechanical or even heater probe level sensing). The present invention is designed as a new system or can be added as an upgrade to an existing system.

The present invention can take advantage of existing dryer technologies, for example, both utilizing variable speed drive or cycling, energy efficient refrigerant systems or less efficient non-cycling configured systems, and, delivers an optimal dew point at all external prevailing conditions. The dryer performance is stable, balanced and will deliver dew point at setting (according to the capacity of the design without hunting). It is important to understand that although the preferred embodiment is with a flooded shell, of a tube and shell, evaporator (as the refrigerant side of the heat exchanger), that the present invention would work equally as well if located on the "tube" side or indeed any evaporator configuration. Refrigerant metered return, is accomplished with the same stable results.

Thus the present invention provides improvement over the conventional art by allowing more efficient use of the evaporator by maintaining the liquid level throughout the entire evaporator. The present invention also limits the "hunting" that has been accepted in conventional systems. With use of present invention one can maintain stable, balanced parameters affording very high performance in the dew point of the output of a gas/air dryer system.

These and other objects, features, and advantages of the present invention will become apparent upon a reading of the detailed description and claims in view of the several drawing figures.

DETAILED DESCRIPTION OF THE INVENTION

Figure 1:
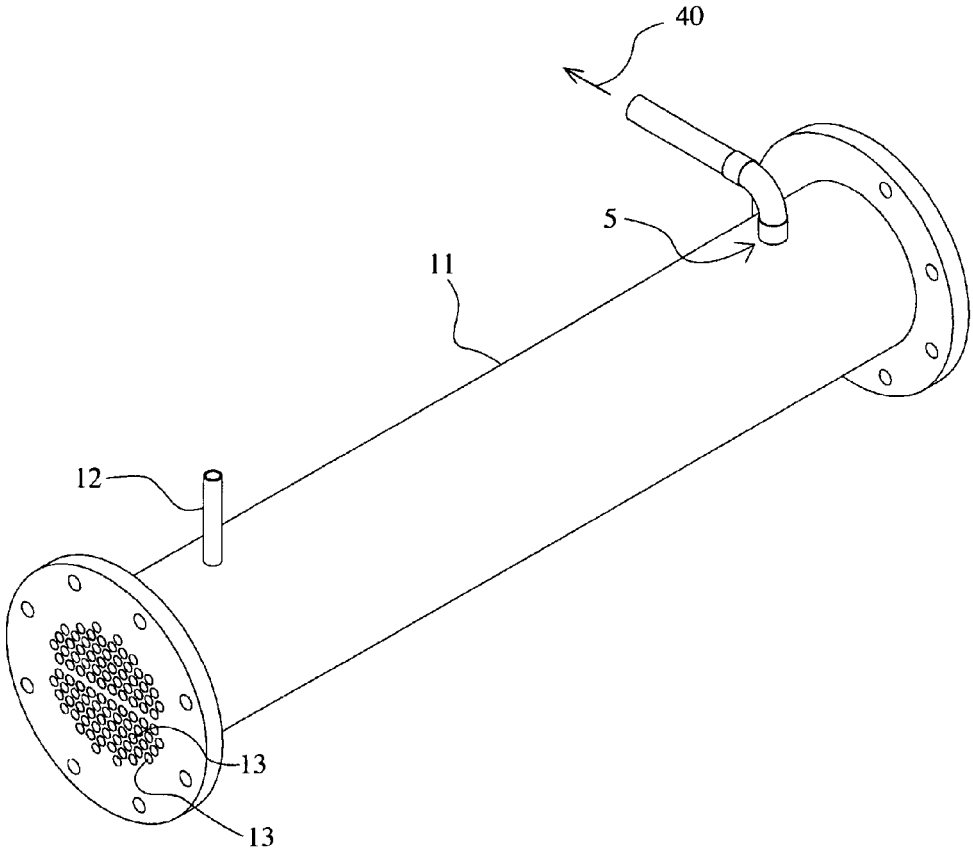
(PRIOR ART) FIG. 1
FIG. 1 is a perspective view of a refrigerant evaporator vessel without the flow metering structure of the present invention.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

Adverting now to the drawings, FIG. 1 is provided as an example of a conventional system. FIG. 1 shows a flooded shell side method apparatus configured as is conventional in the art, where the level of refrigerant is controlled by the refrigerant feed into the refrigerant inlet 12 and out to the refrigerant exit port 5. Refrigerant is being sucked back to the accumulator or compressor which flows out of evaporator shell 11 through exit port 5. As it passes by the expansion valve regulating bulb (not shown), the refrigerant suction temperature lowers; causing the expansion valve to close down reducing or cutting off the refrigerant feed to refrigerant inlet 12. As the suction temperature rises, the expansion valve re-opens increasing the flow of refrigerant to/or flooding refrigerant inlet 12 and thus the level of refrigerant in evaporator shell 11 rises and reaches a point where more suction occurs at exit port 5. The suction results in a bolus or gulp of refrigerant returning because the level reaches return outlet exit port 5 of the evaporator shell 11 and the process starts recycling over again (e.g., regulating bulb senses a fall in suction temperature due to the large amount of cold refrigerant in the gulp). The expansion valve closes-down, suction temperature rises, over time the expansion valve re-opens, refrigerant level over fills, gulps or slugs of refrigerant return through outlet exit port 5 via suction and so forth and so on as the process repeats in an endless cycle. In the art of refrigerant systems, a calculation of suction temperature and suction pressure is generally referred to as 'superheat'. A vacillating superheat temperature would cause the expansion valve to hunt or vacillate as described above.

Figure 2:
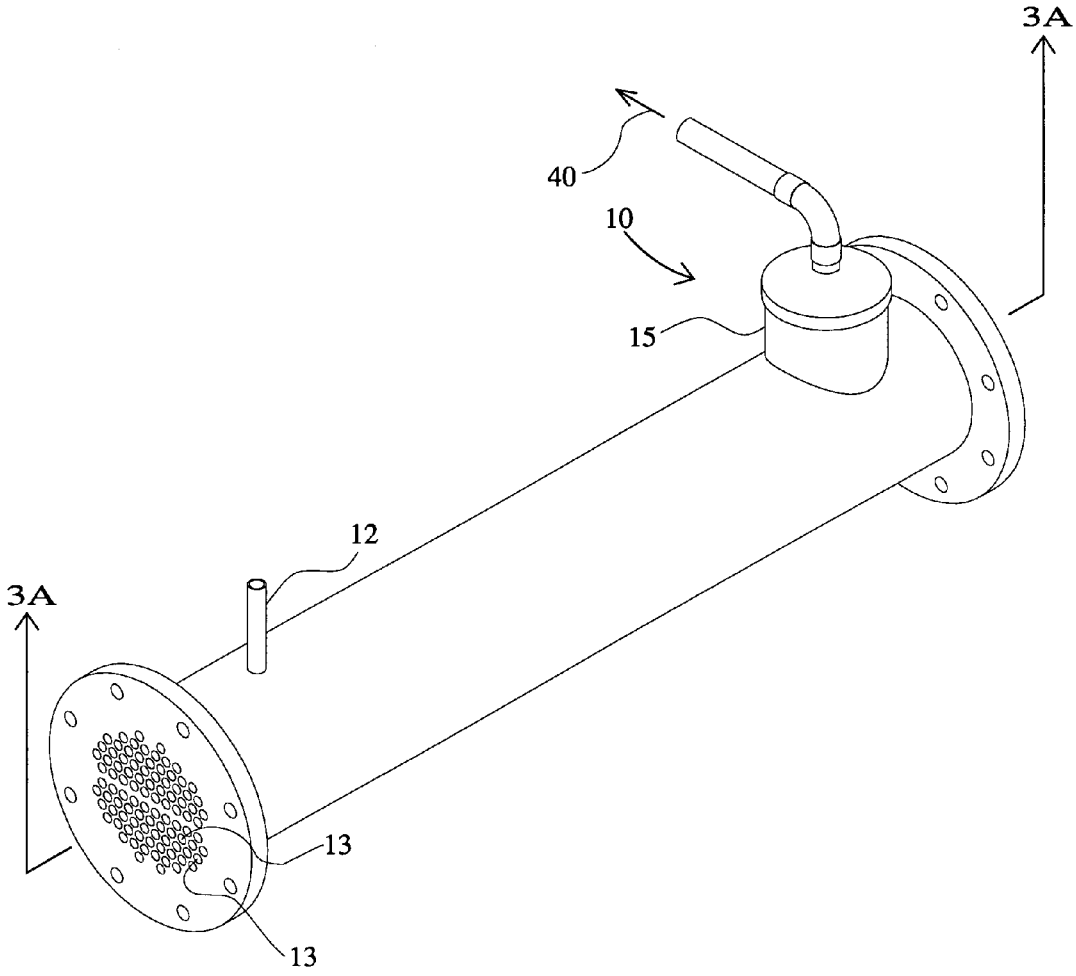
FIG. 2 is a perspective view of a preferred embodiment of the present invention positioned atop a refrigerant evaporator vessel.

A preferred embodiment of a refrigerant receiving apparatus of the present invention as shown in FIG. 2 provides a means to control flow through outlet exit port 5 (the return of refrigerant) to the accumulator or compressor. FIG. 2 illustrates evaporator shell 11 configured with refrigerant receiving apparatus 10 having flow metering structure 15, a preferred embodiment of the present invention. The bottom of flow metering structure 15 is preferably ellipsoidal in shape with the spheroid radius mating at the top most quadrant of the evaporator shell 11. Refrigerant vapor and liquid can freely rise up and into flow metering structure 15 as refrigerant is injected into the vessel through refrigerant inlet 12. The heat exchange evaporator vessel enclosed by evaporator shell 11 has the compressed air or gas passing through 'tube' side 13 where upon the air or gas temperature will achieve a dew point programmed via the dryer's control settings (as is conventional). The air or gas passing through tubes 13 is what is referred in this document as providing the "load" or "demand."

This embodiment of the present invention overcomes the constant over/under feed process into the system at refrigerant inlet 12 of a system without a refrigerant receiving apparatus. The present invention has a measured or metered refrigerant return. The superheat is stabilized by virtue of little sips of refrigerant (rather than the gulping phenomena earlier described). The constant sips in effect, adjust the superheat temperature slowly enough to allow the expansion valve regulating bulb to respond and feed at refrigerant inlet 12 in a more graded and controlled manner. This metered feeding of the expansion valve lowers the volume of the returned refrigerant at return outlet exit port 5 and the superheat temperature thus slowly rises. The slow temperature rise in turn re-opens the expansion valve again slowly and the sipping is metered such that over a few cycles, the expansion valve is stable at whatever degree of openness, and is in a position that is ideal for any given load demand.

In addition, as the load (on the refrigeration system) changes, the demand for refrigerant will cause the expansion valve opening to either increase or decrease respective of the need (less cooling or more cooling). But unlike a conventional system without a flow metering structure that falls subject to endless hunting of the expansion valve due to change in delivery of refrigerant (large gulps of refrigerant at times and no refrigerant at times), the present invention constantly meters as to the quantity of refrigerant being sipped up. This is accomplished as internal level 55 (of refrigerant) within internal tube 25 rises or falls (as superheat temperature dictates) and the level of refrigerant is metered by contact with return orifice 30. Flooded shell 11 is always filled with liquid refrigerant providing the highly desirous maximum chilling of all tubes 13 within the evaporator vessel. The refrigerant level in fact is up into the cup area and is positioned within return orifice 30 or array of vertical small return orifices 30 in internal tube 25. The small holes allow constant metering of refrigerant to be sucked-up and refrigerant returned. The metered (small sips) returns of refrigerant cause only incremental superheat temperature changes to the expansion valve regulation bulb. The regulation bulb responding in a vernier manner to either expand or contract the expansion valve opening which results in a stable refrigerant level at the cup tube area where the metering occurs. The system now can deliver metered feed of refrigerant and the operation is efficient, steady, consistent and reliable.

The result is a fully controlled vernier feed of the expansion valve. The vernier feed of refrigerant results in a more stable full level within the evaporator, maximizing its efficiency and giving a constant dew point. The stable refrigerant level leads to a more constant metering rate while keeping the shell 100% flooded. As a result the present invention is self re-enforcing. It does not hunt because it does not send gulps or liquid slugs within the scope of normal range operation.

It should be appreciated by those of ordinary skill in the art that the only time the present invention allows a gulp of refrigerant to return is when there is a very large and sudden increase in demand. This rapid change in demand may cause the refrigerant level to overshoot and would appropriately cause the result in a rapid change of superheat temperature and the expansion valve regulating bulb to fully close the valve curtailing any further refrigerant feed. In similar less extreme cases where the load demand would change more slowly, the system of the present invention (returning refrigerant liquid and vapor, and oil at the current loaded rate of metering) would cause the expansion valve to move to the closed position (less refrigerant feed equals less metering), until finally the expansion valve is fully closed (resulting in much less or no refrigerant flow).

In either case, once the load was re-established, either rapidly or slowly applied, the superheat temperature would rise again, due to the demand, at the expansion valve regulating bulb. The valve would allow refrigerant to flow into the evaporator once again. When the level reaches flow metering structure 15 of the present invention, return of refrigerant flows in the direction of arrow 40 as refrigerant is metered in small sips as the refrigerant feed into refrigerant inlet 12 is quickly determined and stabilization is achieved.

Figure 3A:
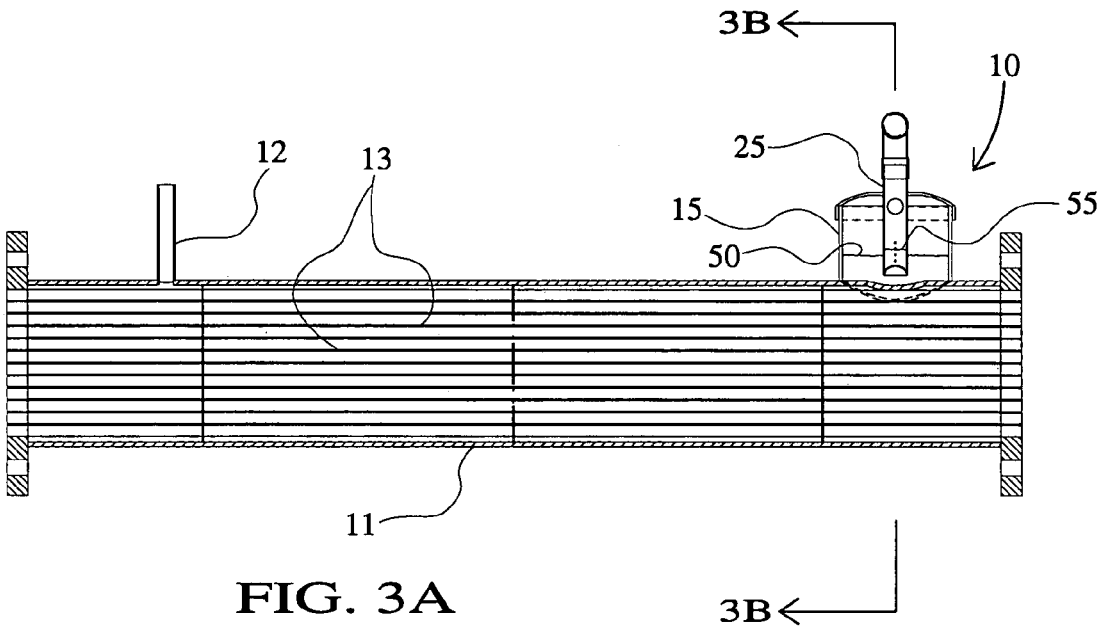
FIG. 3*a* is a cross sectional side view of the present invention positioned atop a refrigerant evaporator vessel taken generally at plane 3A-3A of FIG. 2.
Figure 3B:
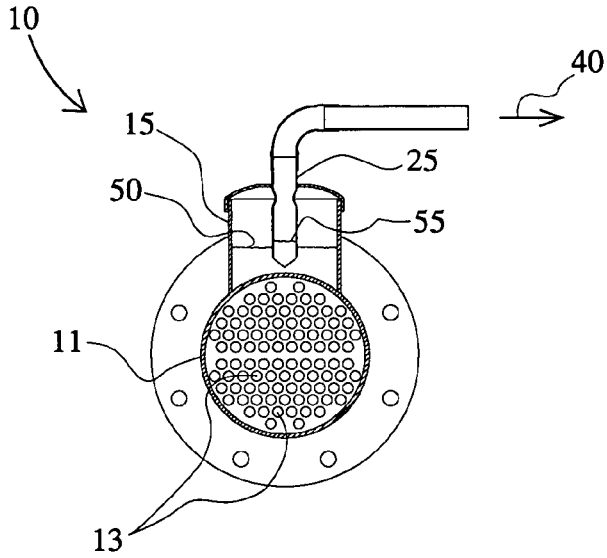
FIG. 3B end view of the invention taken generally at plane 3B-3B of FIG. 2.

FIGS. 3A and 3B are cross sectional illustrations showing side structure tubes 13 within the evaporator shell 1. Structure 15 is affixed to the shell 11 by a weld seam 16. One feature of the present invention is improved heat exchange by fully submersing all of tubes 13 in liquid refrigerant (since the refrigerant level is up into flow metering structure 15).

Figure 4A:
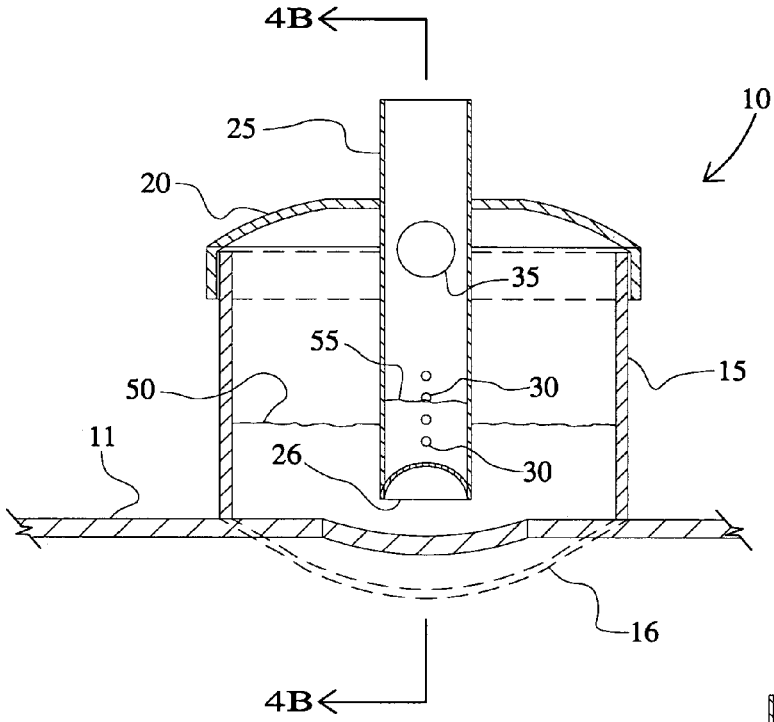
FIG. 4A is a cross sectional side view of the present invention showing the refrigerant level and the relationships to the return tube.
Figure 4B:
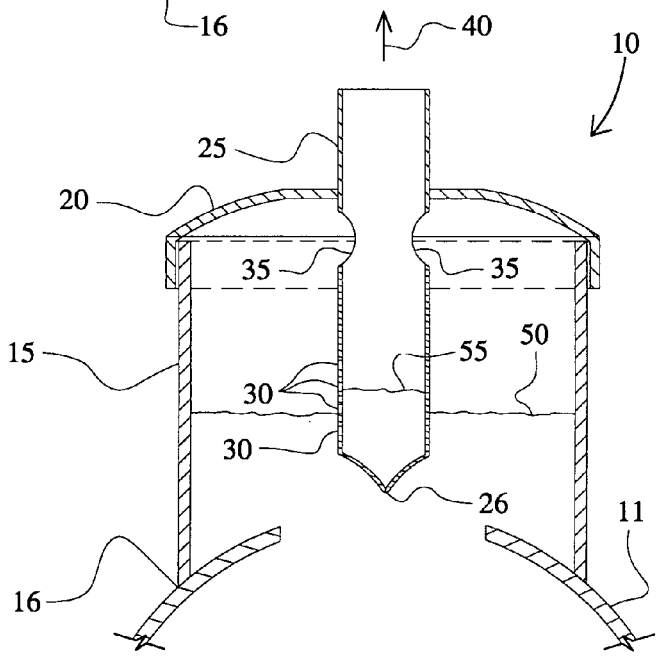
FIG. 4B is a cross sectional view of the present invention taken generally at plane 4B-4B of FIG. 4A.

In the preferred embodiment of refrigerant receiving apparatus 10 flow metering structure 15 is a small closed container or cup as shown in FIG. 4A as a protrusion attached to a flooded shell side evaporator. FIG. 4A depicts flow metering structure having a top cap 20 and a return metering flow metering structure 25 protruding through top cap 20. Top cap 20 may be installed on or may be integral with flow metering structure 15. Internal tube 25 is preferably cylindrical, but may be any desired shape. If internal tube 25 is not cylindrical, a diameter equivalent may be determined as the diameter as a round tube having the same cross sectional area. Internal tube 25 preferably has a bottom 26 capped or pinched closed that is below a liquid refrigerant level 50. Internal tube 25 protrudes through top cap 20 to allow refrigerant to exit flow metering structure 15. Instead of a crimped bottom 26 the bottom may be capped or otherwise plugged, such as an open end plugged by liquid refrigerant below refrigerant level 50. FIG. 4B is a cross sectional view of the present invention taken generally at plane 4B-4B of FIG. 4A. FIG. 4B illustrates two large return orifices 35 positioned distal to crimped bottom 26.

Flow metering structure 15 is located on the upper most surface of shell 11 and refrigerant level 50 can freely rise up into flow metering structure 15 confines. Flow metering structure 15 has an internal tube 25 with at least one return orifice 30(*a*) which allows passage of liquid refrigerant outside the internal tube into the internal tube, and at least one return orifice 30 or 35(*b*) which allows passage of gas outside the internal tube into the internal tube. Internal tube 25 extends from the bottom area of flow metering structure 15 (and under the refrigerant level 50) and out through the top 20 of flow metering structure 15. Internal tube 25 then returns refrigerant in the direction of arrow 40 to the accumulator or compressor (or other refrigeration systems). Bottom 26 of flow internal tube 25 within flow metering structure 15 is preferably closed off, for example crimped or plugged. It should be understood that each of the embodiments of the present invention can be made with or without crimped bottom 26. The end of the internal tube may be left open to be plugged by refrigerant in flow metering structure 15.

In a preferred embodiment, internal tube 25 has a series of holes, for example 2, 3, 4 or more vertically disposed in an approximate range of about 15 to 35 percent to about 40 to 60 percent, preferably disposed vertically from about 25 to about 50 percent up from end 26 of tube 25. The small return orifices 30 starting proximal to internal tube structure bottom 26 and at least one or a series of large return orifices 35. These orifices are spaced proportionally in a predetermined distance upwardly, scaled to the size of the refrigerant system. A preferred embodiment has one, preferably two or more large orifices 35 whose total area is in a range of about ½ to 2 times, more preferably about 0.8 to 1.2 times and still more preferably about equivalent to the cross sectional area of the inside diameter of internal tube 25. Preferably the width of the large orifice has a cross measure (measure horizontal to vertical rise of the internal tube 25) larger than a cross measure of a small orifice 30. In preferred embodiments large orifices 35 have a cross measure at least about two times, preferably about three times, more preferably about four or about 5 times a cross measure of a small return orifice 30. In a preferred embodiment where large and small orifices 30 and 35 are round, a large orifice 35 with a cross measure about two times a diameter of a small return orifice 30 will have an area about four times an area of a small return orifice 30. A less preferred embodiment incorporates return orifice 30 and 35 as one orifice. For example the one orifice may be elongated and have a region proximate to internal tube bottom 26 with a small cross measure, but may have a larger cross measure higher up internal tube 25. For example the return orifice may have a shape similar to a classic keyhole shape with a lower slot shape region topped with a large round region. These large return orifices 35 are located at the upper most area of flow metering structure 15 just under and inside top 20. The purpose of the large orifices is threefold, 1) allow the free return of refrigerant vapor to pass, 2) atomizes liquid refrigerant being metered up from lower orifices 30, and 3) should the refrigerant surface level 50 rise rapidly (as was earlier discussed in the example of the load demand suddenly changing to low or off), the presence of large orifices allows the system to gulp; resulting in an immediate fall in superheat temperature and appropriately, fully closing the expansion valve. The closing of the expansion valve stops or reduces feed of refrigerant to refrigerant inlet 12 and causes refrigerant levels 50 and 55 to drop and normalize to the new demand condition; and the process starts all over again finding the exact flow rate of metering of the return refrigerant. The dimensions provided above are for reference purposes only. It should be understood other combinations of dimensions are also possible.

The small metering orifices 30 sip liquid refrigerant that is returned. The sipping process is accomplished as refrigerant level 50 engages the area of small metering orifices 30 allowing refrigerant access into internal tube 25. The compressors suction causes refrigerant level 55 within internal tube 25 to be higher than the level 50 outside internal tube 25. This differential in levels 50 and 55 is dependent on the amount of return refrigerant at any given load and the status of the evaporator valve (not shown). The sip or metered return occurs as the surface liquid refrigerant 55 crosses any one of the orifices of internal tube 25. In some cases bubbling of vapor through an orifice 30 atomizes liquid. Surface turbulence can also contribute to sipping. As the surface 55 engages an orifice, vapor phase moving across the liquid at the surface disturbs the surface and flashes liquid refrigerant as the surface tension is overcome. The flashing may be considered atomizing as the liquid phase refrigerant passes up internal tube 25 where it mixes with more vapor returning at orifices 35. The result of atomizing or flashing is very small droplets of refrigerant being carried up and out internal tube 25. These sips are consistent in flow quantity and occur rather uniformly with respect to rate. The rate is dependent on the differential between the inner and outer levels 50 and 55. Should the suction increase, causing greater differential in between levels 50 and 55, a higher orifice 30 on internal tube 25 is engaged at the surface and the flashing occurs at a faster rate. Conversely, should the suction decrease, as the demand for refrigerant decreases, the differential in levels is closer to equal. In this case, the level 55 would engage with metering orifices 30 lower on the internal tube 25. The sipping occurrence (level 55 filling meter orifice at its surface) is much less because the suction occurrence is less and vapor through orifice 35 will carry out less liquid. It is apparent that the metering of return refrigerant is always controlled, sip by sip at low demands or at high demands as the case may be. But at extreme demands, large return orifices 35 may engage.

Figure 5A:
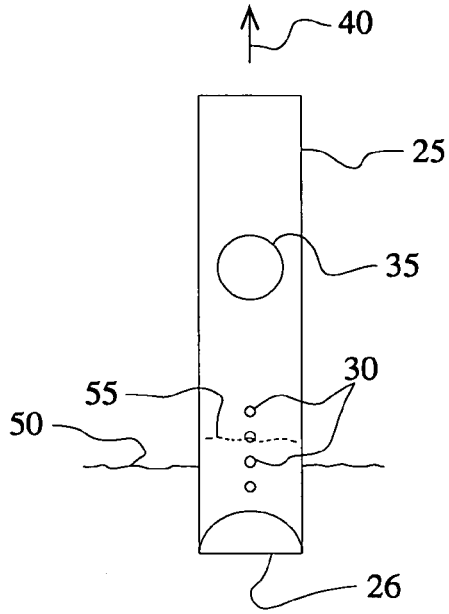
FIG. 5A is a perspective view of a preferred embodiment of the refrigerant metering return tube of the of the present invention.
Figure 5B:
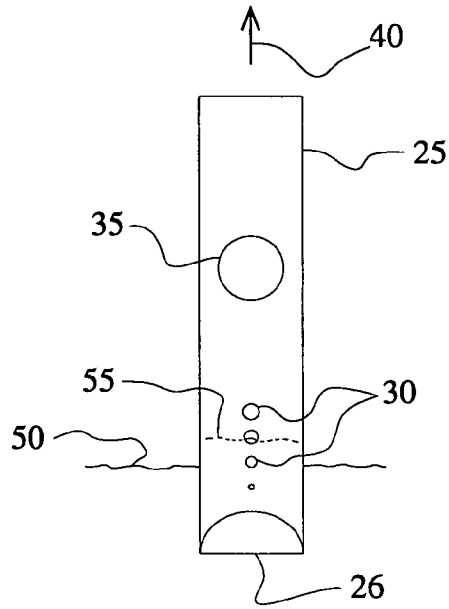
FIG. 5B is a perspective view of a second embodiment of the refrigerant metering return tube of the present invention.
Figure 5C:
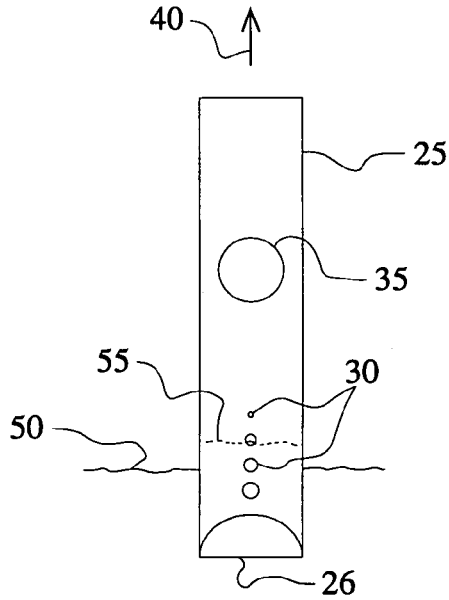
FIG. 5C is a perspective view of a third embodiment of the refrigerant metering return tube of the present invention.
Figure 5D:
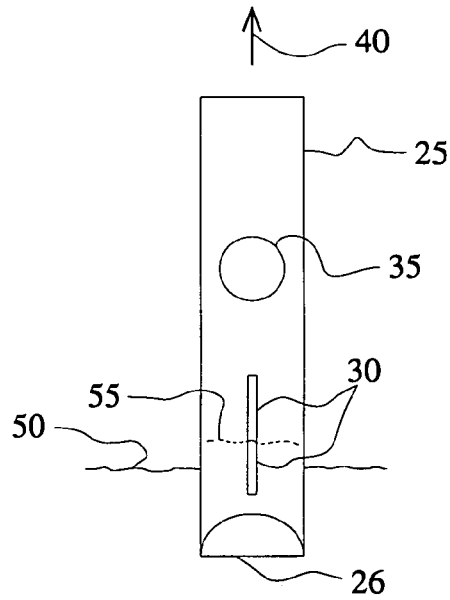
FIG. 5D is a perspective view of a fourth embodiment of the refrigerant metering return tube of the present invention.
Figure 5E:
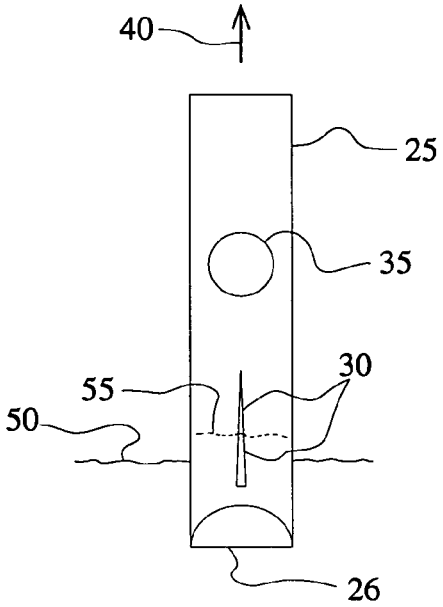
FIG. 5E is a perspective view of a fifth embodiment of the refrigerant metering return tube of the present invention.
Figure 5F:
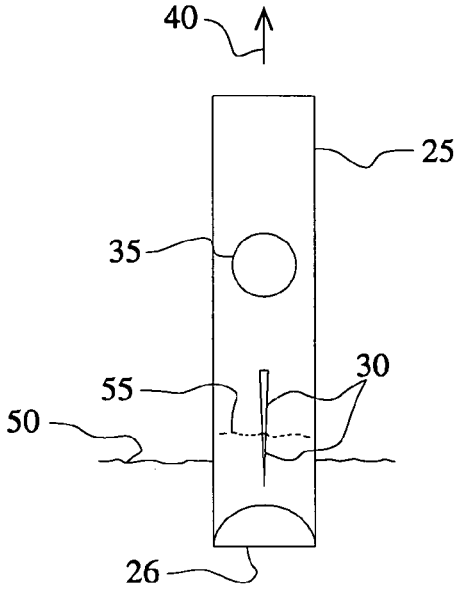
FIG. 5F is a perspective view of a sixth embodiment of the refrigerant metering return tube of the present invention.
Figure 5G:
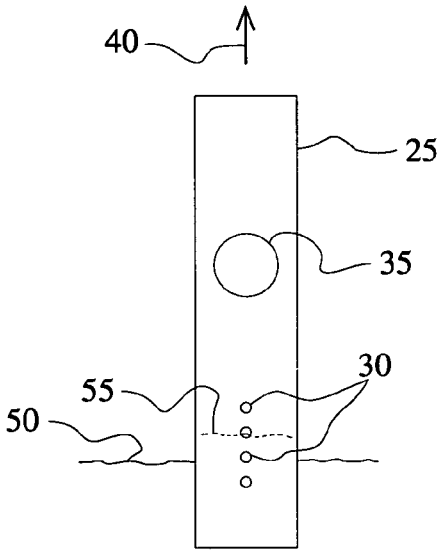
FIG. 5G is a perspective view of a seventh embodiment of the refrigerant metering return tube of the present invention.
Figure 5H:
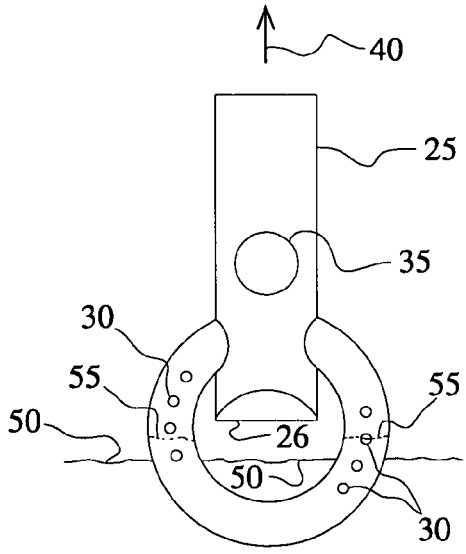
FIG. 5H is a perspective view of an eighth embodiment of the refrigerant metering return tube of the present invention.

FIGS. 5A through 5H show small return orifices in a number of possible configurations. FIG. 5A illustrates small orifices 30 of about equal size, while 5B and 5C show the orifices of different diameters (descending or ascending in size) as the case may be, respectively. Still another configuration is depicted in FIG. 5D, where the return orifice 30 is a slot. FIGS. 5E & 5F illustrate the slot tapered either wider at the bottom or wider at the top, respectively. Orifices need not be round but round holes are preferred for manufacturing ease. Similarly slotted holes need not be rectangular or triangular, but can be any elongated shape, for example, a parallelogram, an ellipsoid, U shape, etc. The many configurations of return orifice 30 allow the scope of the present invention to be fabricated in a broad range of configurations; all delivering a metered return of refrigerant. It must be understood that the shape of return orifice 30 as shown FIGS. 5A through 5F is for illustration purposes only and it should be readily apparent to those of ordinary skill in the art that return orifice 30 could be made in any other shape.

Figure 6:
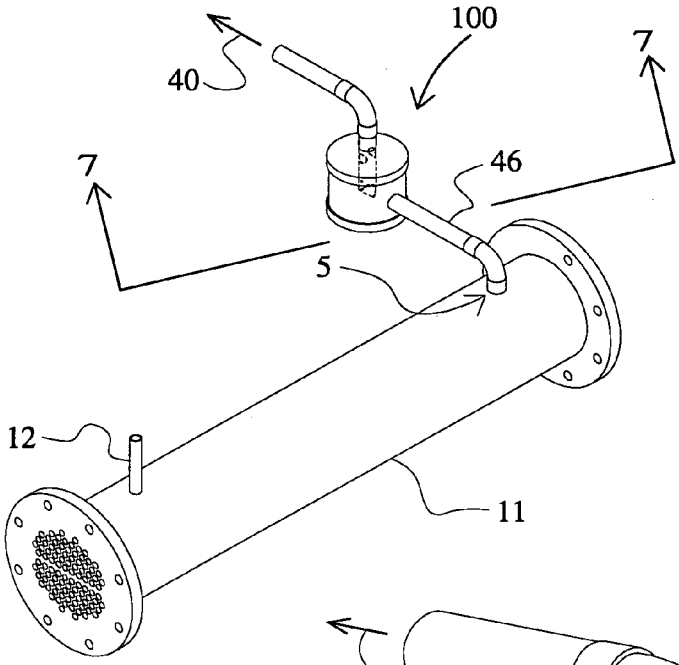
FIG. 6 is a perspective view of a first alternate embodiment of the present invention externally positioned to the refrigerant evaporator vessel.
Figure 7:
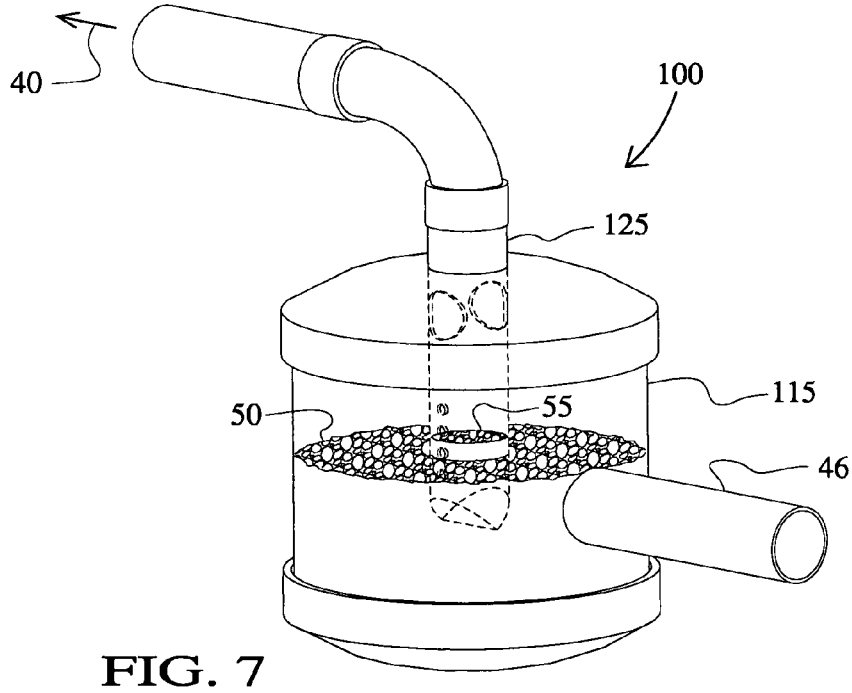
FIG. 7 is a cross sectional side view of a first alternate embodiment of the present invention taken generally at plane 7-7 of FIG. 6.

FIGS. 6 and 7 are illustrations depicting another preferred embodiment of refrigerant receiving apparatus 100 of the present invention wherein a non-cycling system is equipped flow metering structure 115 is completely separated from the evaporator shell 11. The embodiment 100 can be most useful as a retrofit to existing refrigerant dryer system. In this an alternate embodiment of refrigerant receiving apparatus 100 depicted in FIG. 6 flow metering structure 115 is vertically positioned at evaporator return tube 46 extending out of the topmost side of the evaporator shell. Tube 46 is an elbow connecting port that enters flow metering structure 115. Flow metering structure 115 is a cylindrical small vessel with the top and bottom of the vessel capped closed. Internal tube 125 (with small holes near the bottom area and larger holes at the top) is constructed as described in the first preferred embodiment. Further this internal tube 125 extends out of the top region and is connected to refrigerant exit port 5 as is described above. The position where the flow metering structure 115 is inserted into the return line 46 of evaporator shell 11 is arbitrary, for example, depending on space considerations. The function of the flow metering structure 115 is akin to that of the flow metering structure 15, with only a slight compromise of flow from the evaporator to the structure due to the return line tube 46.

Figure 8:
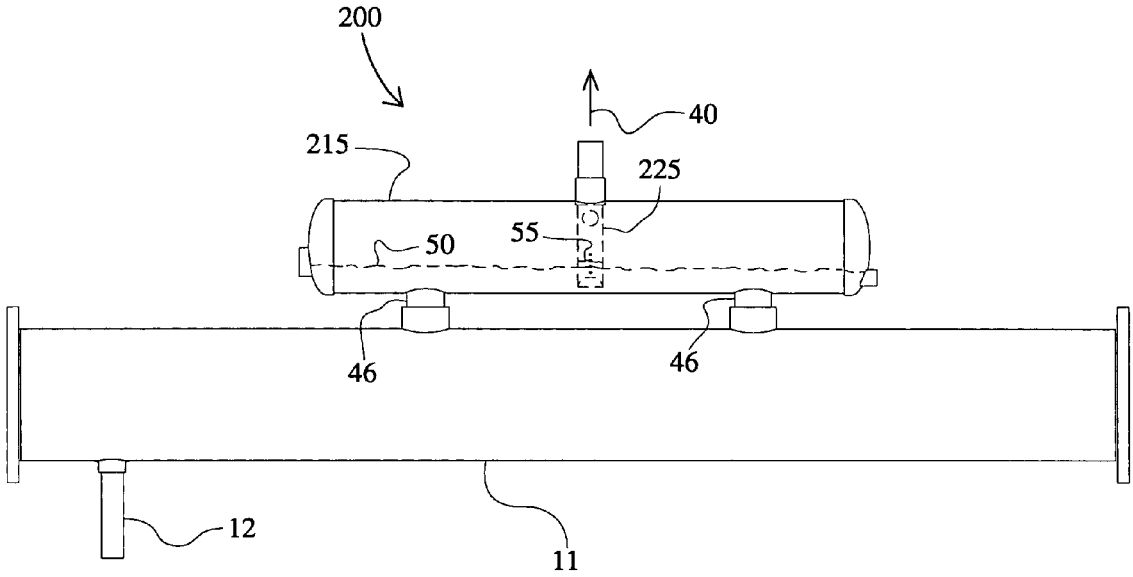
FIG. 8 is a cross sectional side view a second alternate embodiment of the present invention.

Still another embodiment of the present invention is illustrated as receiving apparatus 200 in FIG. 8. Receiving apparatus 200 comprises a satellite elongated flow metering structure surge vessel 215 used in conjunction with shell 11 of the evaporator. Surge vessel 215 and shell 11 are disposed in parallel spaced-apart relationship to one another. Surge vessel 215 located above, preferably directly on the top of the shell 11 and is connected via one or more ports 46. This configuration is preferred and particularly useful in large capacity systems where great amounts of refrigerant can be accommodated and a large overflow volume may extend up into the surge vessel where the metered return can take place. The purpose of the surge vessel 215 is to allow space for overflow of liquid refrigerant to collect. Return refrigerant exits from the top of surge vessel 215 using internal tube 225 similar to internal tube 25 as is described herein. Although the shape of surge vessel 215 is not in direct contact with shell 11 of the evaporator, the system functions analogously to a completely contained system. Differential levels 50 and 55 have similar considerations as in the other embodiments. Internal tube 225 is configured as in other embodiments.

In operation, receiving apparatus 200 as the refrigerant level rises up and into the surge vessel 215 internal tube 225 extending below the level 50 of refrigerant suction pulls refrigerant into return orifice 30 thus maintaining metering occurrences of refrigerant. Since the level 50 is up and into the surge vessel 215, all of the evaporator tubes 13 are fully submerged as is desirous and the system would perform in the same manner as the preferred embodiment. It should be noted that a system having a surge vessel without internal tube 225 of the present invention would erratically function with cyclical operation expansion and thus routinely experience the same over/under performance as a device without a flow metering structure. In such a system, the level would rise up to the top of the surge vessel and gulps and slugs of refrigerant would return causing large changes in suction temperature at the expansion valve regulating bulb and thus the starting the endless hunting cycle.

In the each receiving apparatus embodiment 10, 100 and 200, the refrigerant level 50 would rise up into the flow metering structure, to the area where sucking occurred and refrigerant is metered via the small return orifices 30. And likewise, should the refrigerant level rise up to the larger return orifices 35 at the top of the flow metering structure 25, 125 or 225, sufficient refrigerant return would occur to cause the suction temperature to drop more rapidly and result in the expansion valve appropriately fully closing.

The metered refrigerant return process, of the present invention, allows full refrigerant feed capacity when needed (when demands are great), moderate feed as requirements call for less, and uniquely, a vernier feed to trim the need for any demand to exact feed requirements. This metered approach affords stability to systems that conventionally are expected to hunt.

Figure 9:
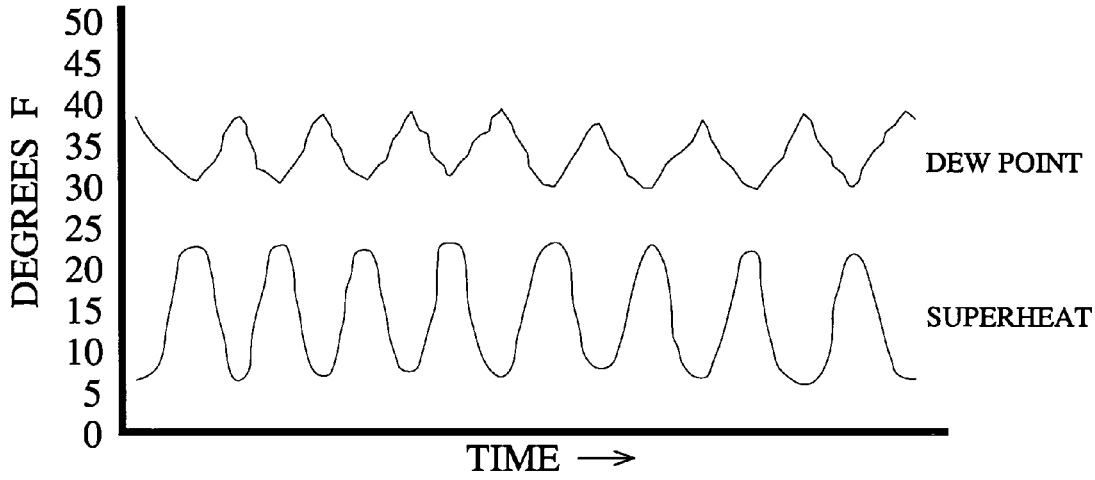
FIG. 9 is a graph illustrating hunting behavior of the dew point and superheat parameters of a refrigerant dryer system without the present invention.
Figure 10:
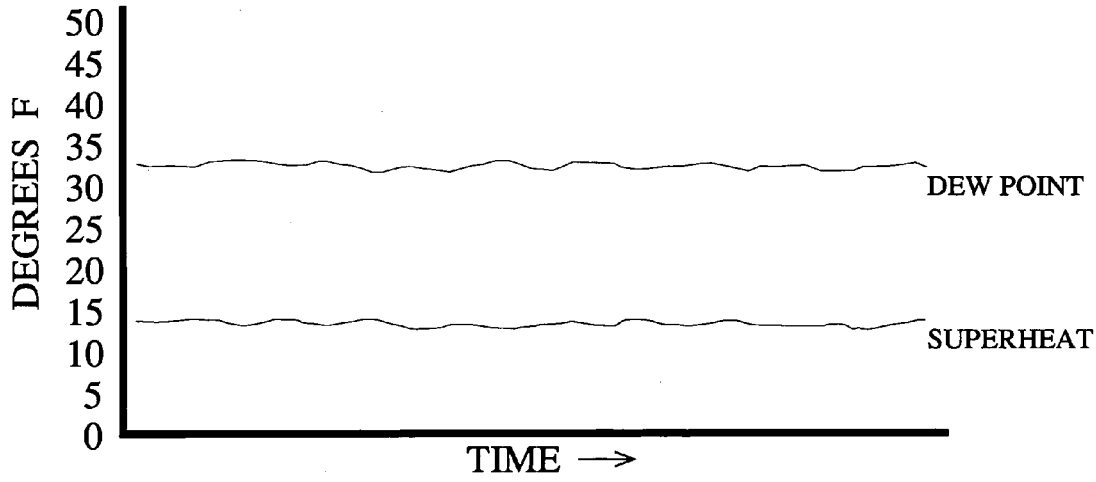
FIG. 10 is a graph showing stable parameters of dew point and superheat produced by refrigerant system with the present invention.

In accordance with the present invention, FIG. 10 is a graph that illustrates the result is substantially flat-lined parameters with the dew point settled at the set point (for example 34° F.) and super heat at (for example 17° F.). FIG. 9 is a graph that illustrates the results of a compressed gas/air dryer system without a refrigerant receiving apparatus showing the superheat continually scaling to high (and overshoot) then low (and overshoot). This overshooting is caused because of the suction line heat exchanger demand (load on the gas/air dryer), sending a different messages to the refrigerant expansion valve. The end result is a valve that is opened too much, then closed too much, resulting in the dew point to be above the set point followed by the dew point being below the set point. The graph depicted in FIG. 10 charts a system utilizing the present invention shows how all the parameters are stabilized to a level of balance.

In the present invention these parameters, which are interrelated, are flattened out or dampened so to speak, e.g., the dew point would find the set point value and remain there. The superheat responds to demand changes instead of just responding to the peaks and valleys of the hunting expansion valve oscillations. The expansion valve no longer oscillates due to erratic superheat response. The valve simply seeks its balance, and finding the rhythm, of its own need and will only modestly modulate always tracking the demand. The system thus will output close to perfect or even perfect, dew point temperature according to the gas/air dryer's capacity.

Thus, it is seen that the objects of the invention are efficiently obtained. It will be understood that the foregoing description is illustrative of the invention and should not be considered as limiting and that other embodiments of the invention are possible without departing from the invention's spirit and scope.

What is claimed is:

1. A system for modulating refrigerant flow from an evaporator of an air or gas drying apparatus wherein said gas or drying apparatus has an evaporator shell with at least one exit orifice for return of refrigerant to an accumulator or compressor, said system comprising a flow metering structure connected to said at least one exit orifice enclosed within a closed container mounted on said evaporator shell, said structure having an internal tube with a vertical rise from an evaporator shell end to an accumulator or compressor end, said internal tube having at least one return orifice (a) which allows passage of liquid refrigerant outside said internal tube into said internal tube, and at least one return orifice (b) which allows passage of gas outside said internal tube into said internal tube.

2. The system of claim 1 having a return orifice (a) and a return orifice (b) wherein said return orifice b) is more proximal to said accumulator or compressor end than said return orifice (a) and said return orifice (b) has a cross measure larger than a cross measure of return orifice (a).

3. The system of claim 1, wherein said at least one return orifice (b) is more proximal to said accumulator or compressor end than said return orifice (a).

4. The system of claim 2 wherein said return orifice (b) has a diameter equivalent of about one half of the diameter equivalent of the cross-sectional area of said internal tube.

5. The system of claim 3 with two return orifices (b) each having a diameter equivalent of about one half of the diameter equivalent of the cross-sectional area of said internal tube.

6. The system of claim 1 wherein said air or gas drying apparatus comprises an expansion valve for feeding compressed refrigerant to a heat exchange vessel.

7. The system of claim 1 wherein said at least one return orifice (a) has an elongated shape, the length of which is disposed in the direction of said vertical rise.

8. The system of claim 1 wherein said at least one return orifice (a) is a plurality of orifices serially disposed in the direction of said vertical rise.

9. The system of claim 2 wherein said return orifice (b) allows passage of gas during normal operation, but also allows passage of liquid when required by rapid changes in load demands of the system.

10. The system of claim 1 wherein said orifice (a) and said orifice (b) are the same orifice.

11. The system of claim 1 wherein said internal tube has a sealed bottom.

12. The system of claim 11 wherein said sealed bottom is crimped.

13. The system of claim 11 wherein said sealed bottom is capped.

14. The system of claim 1 wherein said internal tube has an open bottom.

15. The system of claim 1 wherein said internal tube has a u-shape bottom portion.

16. A system for modulating liquid flow in a mixed flow of liquid and gas, said flow from a liquid filled tank to an accumulator or compressor, said system comprising an enclosed container having a top and bottom wherein said bottom is mounted on said liquid filled tank, said enclosed container having a top from which liquid and gas exit and an internal tube through which liquid and gas flow to said top, said internal tube having an orifice to allow liquid to enter said internal tube at a bottom portion and an orifice to allow gas to enter at a top portion.

17. A system for modulating refrigerant flow from an evaporator of an air or gas drying apparatus wherein said air or gas drying apparatus has an evaporator shell with at least one exit orifice for return of refrigerant to an accumulator or compressor, said system comprising: a closed container mounted on the evaporator shell; a cap on said closed container; a communication between said evaporator shell and said closed container to allow flow of liquid refrigerant; a tube internal to said closed container having: atop portion and a bottom portion; an outlet at said top portion through said cap of said closed container; a series of four small orifices serially displaced from proximate to said bottom portion upwards towards said cap; and two larger orifices distal to said bottom portion; said larger orifices having a diameter about ½ the diameter of said internal tube and said smaller orifices having a diameter about ⅕ the diameter of said larger orifices.

* * * * *